United States Patent [19]

Maier et al.

[11] 4,324,963

[45] Apr. 13, 1982

[54] BEVELED LATCH FOR CIRCUIT BREAKER CROSS-REFERENCE TO RELATED APPLICATIONS

[75] Inventors: Alfred E. Maier; Louis N. Ricci, both of Chippewa Township, Allegheny County, Pa.

[73] Assignee: Westinghouse Electric Corp., Pittsburgh, Pa.

[21] Appl. No.: 151,860

[22] Filed: May 21, 1980

[51] Int. Cl.[3] ..... H01H 9/20

[52] U.S. Cl. ..... 200/318; 200/320; 200/153 SC; 74/527

[58] Field of Search ..... 200/318, 319, 320, 321, 200/322, 323, 324, 325, 153 SC, 153 G; 74/527, 529

[56] References Cited

U.S. PATENT DOCUMENTS 2,891,122 6/1959 Froland ..... 200/153 SC

FOREIGN PATENT DOCUMENTS 2513603 10/1975 Fed. Rep. of Germany ..... 200/153 SC

*Primary Examiner*—John W. Shepperd

*Attorney, Agent, or Firm*—L. P. Johns

[57] ABSTRACT

A circuit breaker characterized by a plurality of pole-units adapted for interrupting multi-phase circuits having an operating mechanism releasable to effect simultaneous opening of the multi-phase circuits, at least two latch levers biased against a latch member with each latch lever having a beveled surface to effect simultaneous release of both levers.

9 Claims, 5 Drawing Figures

BEVELED LATCH FOR CIRCUIT BREAKER CROSS-REFERENCE TO RELATED APPLICATIONS

CROSS-REFERENCE TO RELATED APPLICATIONS

This application is related to the copending applications of Alfred E. Maier and Walter V. Bratkowski, Ser. No. 62,273, filed July 30, 1979; and of Alfred E. Maier and James Farley, Ser. No. 77,530, filed Sept. 21, 1979.

BACKGROUND OF THE INVENTION

Description of the Prior Art

Circuit breakers having stored energy mechanisms have been used with single pole as well as with multipole types. A particular construction of such mechanism is primarily dependent upon rating of the breaker. Circuit breakers having high ratings, such as 4,000–5,000 amperes, require increased closing forces for best results. For that reason, the stored energy mechanism includes more closing springs which in turn requires additional latch levers to withstand the greater forces involved.

Associated with the foregoing is a problem of manufacturing tolerances of the levers and cooperating parts. Due to variations in manufacturing tolerances, one latch lever may release before the other and thereby cause high stresses and damage to the later released closing lever.

SUMMARY OF THE INVENTION

In accordance with this invention, it has been found that a more desirable stored energy circuit breaker is provided which comprises a plurality of pole-units adapted for interrupting multi-phase circuits, a common operating mechanism releasable to effect simultaneously opening of the multi-phase circuits, releasable means movable from a latched position to effect opening of the circuits and comprising at least two latch levers, the releasable means also comprising a latch member operable to releasably latch the latch levers, each latch level having a strike surface engaging the latch member for simultaneous release and having a beveled surface extending from the strike surface and the latched level being spring biased against the latch member in the latch position, the latch member abutting the strike surface when latched and moving toward the beveled surface to effect release of the levers, each lever including converging end and side surfaces which comprise the beveled surface and the strike surface, respectively, whereby simultaneous release of both latch levers upon actuation of the latch member is effected.

The advantage of the device of this invention is an increase of the closing force for a high rating circuit breaker mechanism with a corresponding savings of manufacturing costs.

DESCRIPTION OF THE PREFERRED EMBODIMENT

Figure 1:
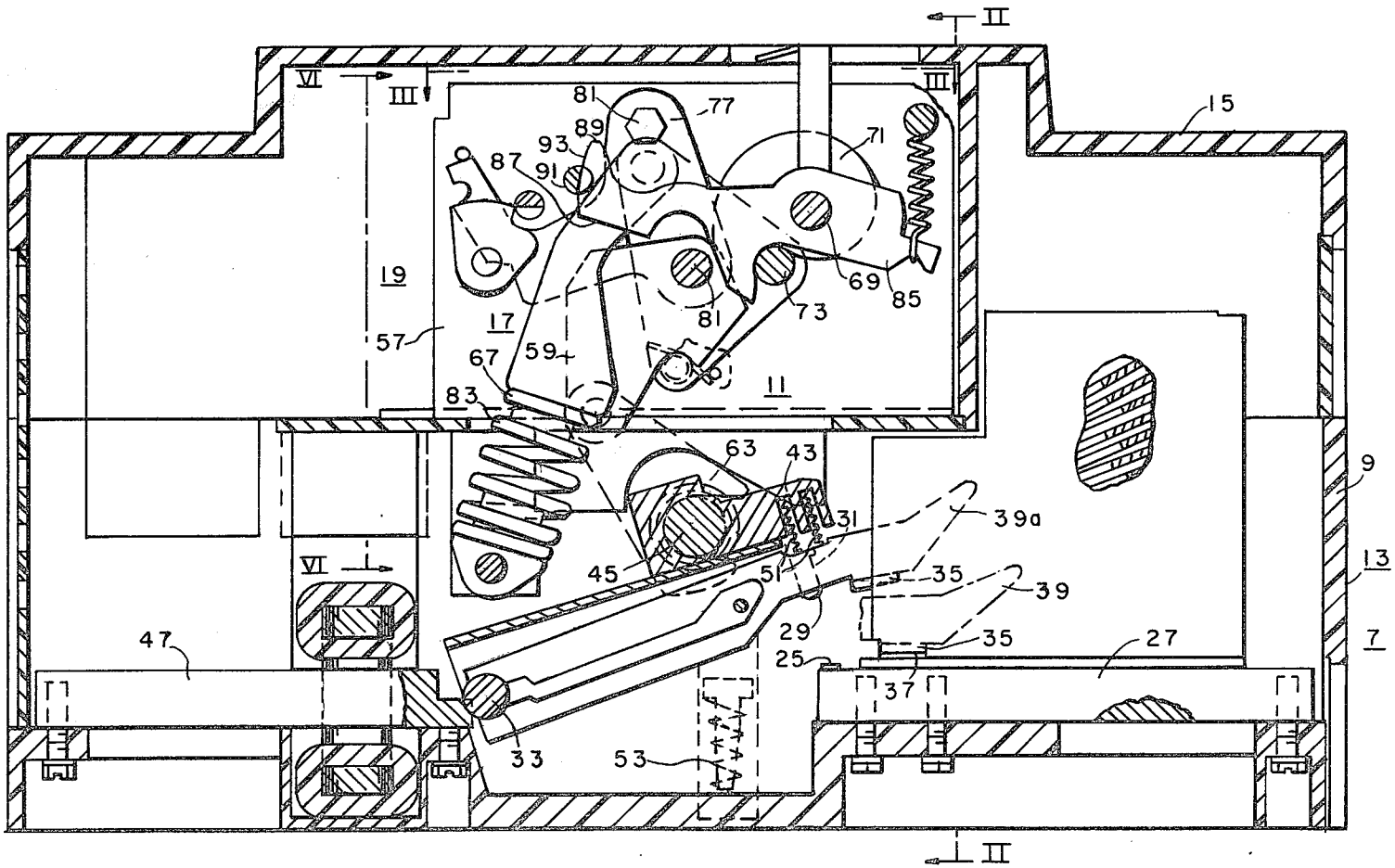
FIG. 1 is a vertical sectional view through a stored energy circuit breaker taken on the line I—I of FIG. 2.

In FIG. 1, a circuit breaker is generally indicated at 7 and comprises an insulating housing 9 and a circuit breaker mechanism 11 supported within the housing. The housing 9 comprises an insulating base 13 and an insulating cover 15.

The circuit breaker mechanism 11 includes an operating mechanism 17 and a latch and trip device 19. Except for the latch and trip device, the circuit breaker 7 is of the type that is generally disclosed in the patent to Alfred E. Maier, et al., U.S. Pat. No. 4,114,005, issued Sept. 12, 1978, and is incorporated by reference herein. The circuit breaker 7 is a three-pole circuit interrupter comprising three compartments disposed in side-by-side relationship. The center pole compartment (FIG. 2) is separated from the two outer pole compartments by insulating barrier walls 21, 23 formed with the housing base 13. The circuit breaker mechanism 11 is disposed in the center pole compartment and is a single operating means for the contacts of all three pole units.

Each pole unit comprises a stationary contact 25 (FIG. 1) that is fixedly secured to a line conductor 27. For each pole unit, a movable contact 29 is secured, such as by welding or brazing, to a contact arm 31. More particularly, a plurality of spaced movable contacts 29 (FIG. 2) are mounted on laterally spaced contact arms 31 for each pole. Each contact arm is pivotally mounted on a pivot pin 33 which is common for all of the contact arms 31. Each pole also comprises a moving arcing contact 35 and a stationary arcing contact 37, the former of which is mounted on arcing contact arm 39 which is pivotally mounted on pivot pin 33.

Figure 2:
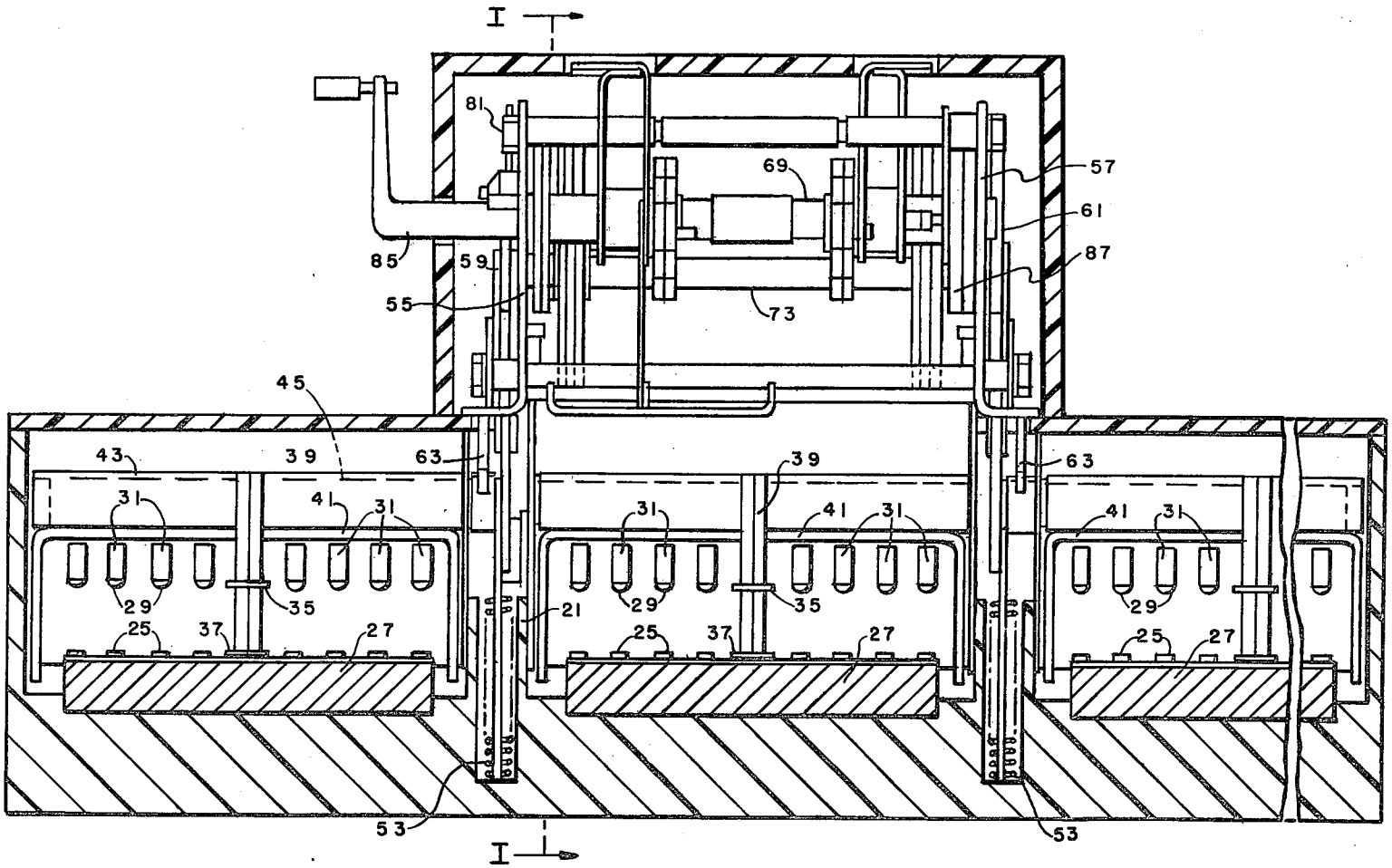
FIG. 2 is a vertical sectional view taken on the line II—II of FIG. 1.

As shown in FIG. 2, each group of contact arms 31 is contained within a support arm 41 which is likewise pivoted on the pivot pin 33. Each arm 41 supports an insulating clamp 43 which is attached to the arm in a suitable manner. The clamps 43 have aligned apertures through which a cross bar 45 extends over the three poles of the circuit breaker 7. The cross bar 45 is used to close all three poles by the circuit breaker mechanism 11. Thus, in the open position, the arcing contact arms 39 are in a raised position as indicated by the broken line position 39*a*, and by the broken line position of the cross bar 45 (FIG. 1). When the contacts are closed, a circuit through the circuit breaker 7 moves from the main conductor 27 and through the contacts 25, 29, the arms 31, and a conductor 47.

Each clamp 43 comprises a pair of two rows of holes 49 with a pair of holes being disposed over each contact arm 31. A coil spring 51 is disposed in each hole and the lower end of each spring presses against the upper side of the contact arm for holding the contacts 25, 29 in tight electrical contact. Moreover, the springs 51 as well as coil springs 53 (FIG. 2) cooperate to bias the cross bar 45 and the movable contacts 23 to the open position.

The operating mechanism 17 actuates the arms 31 between open and closed positions. The mechanism is disposed between a pair of spaced support frames 55, 57. The operating mechanism 17 is described in structure and operation in U.S. Pat. No. 4,114,005, for which reason, only pertinent portions of the mechanism are explained herein. The mechanism comprises a toggle including a first pair of spaced apart toggle links 59, 61, a second pair of spaced apart toggle links 63, 65, and a closing spring assembly 67. The spring assembly 67 is charged with stored energy by a charge structure including a driven shaft 69 and a cam 71 which actuates a cam roller 73, whereby the closing spring assembly 67 is actuated from a discharge to a charged condition for closing the contacts. The driven shaft 69 may be operated either by an electric motor (not shown), or manually by a crank 75.

Moreover, the operating mechanism 17 comprises a pair of toggle latch levers 77, 79 (FIGS. 1, 2) which are pivotally mounted on corresponding frames by similar pivot pins 81 and the lower portion of the latch levers are pivotally connected by similar pivot pins 82 to corresponding toggle links 59, 63.

The closing spring assembly 67 has been augmented to include additional, such as four, closing springs 83 (FIG. 1, 4) instead of two such springs as disclosed in U.S. Pat. No. 4,114,005. Additional springs 83 increases the closing force required for a high rating circuit breaker mechanism involved herein, and the spacing between the frames 55, 57 is increased to accommodate the additional springs. The combination of the increased forces and width between the frames requires that more than one and preferably two latch levers 85, 87 be provided for distributing the lateral stresses on the cam follower roller 73.

Figure 5:
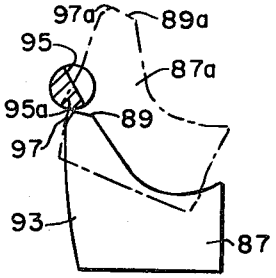
FIG. 5 is an enlarged fragmentary vertical sectional view showing the relationship between a latch lever and a latch trip member.
Figure 4:
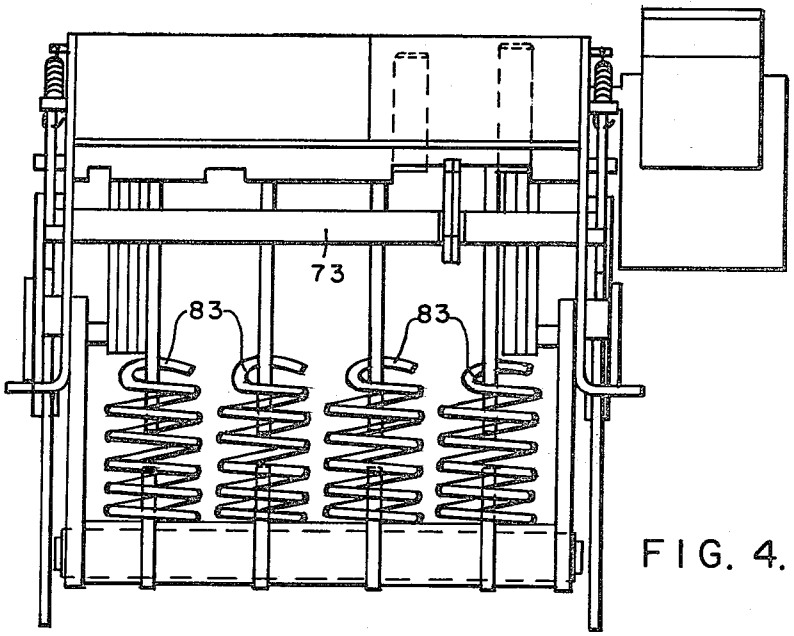
FIG. 4 is a vertical sectional view taken on the line IV—IV of FIG. 1.
Figure 3:
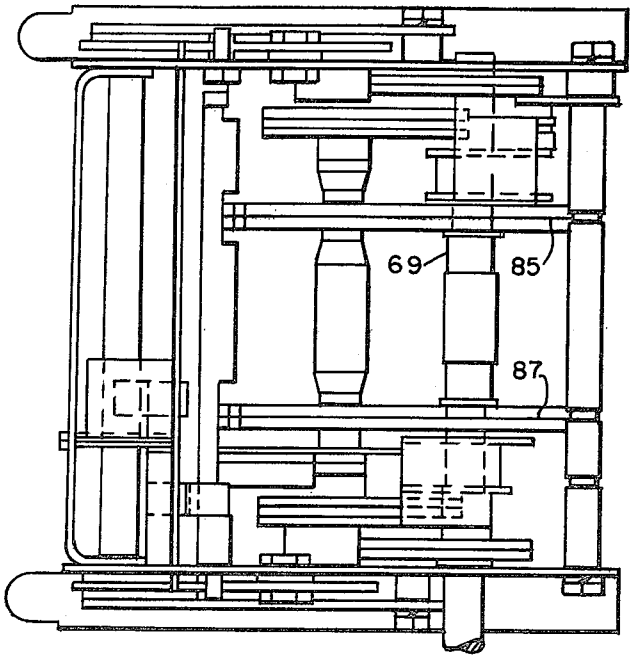
FIG. 3 is a horizontal sectional view taken on the line III—III of FIG. 1.

The left end of each lever 85, 87 (FIG. 5) includes a strike or side surface 89 which engages a latch rod, or D-latch 91 when the levers are in the latched position. Each latch lever 85, 87 also includes an end surface 93. The latch rod 91 is a rod which is rotated about its axis and includes a notch surface 95 which is axially aligned with the surface 89. When the rod 91 is rotated clockwise to a broken line position 95*a* of the notch surface, the levers 85, 87, which are spring biased against the rod 91, rotate upwardly to a position shown by the broken line position 87*a*. Due to variations in manufacturing tolerances in the levers, the rod 91, the frames 85, 87 and other associated parts, it has been found that one of the latch levers 85, 87 may release before the other upon rotation of the rod 91 for which reason the total forces applied by the closing springs 83 would be concentration on only one unlatched lever 85 or 87.

Accordingly, in accordance with this invention, a beveled surface 97 is provided between the surfaces 89, 93. The beveled surface 97 is inclined to both surfaces 89, 93 and preferably at an angle of 30° to a vertical plane. Or the surface 97 is inclined at an angle of 60° to the side or strike surface 89 which is substantially horizontal in the latch position. Upon clockwise rotation of the rod 91 (FIG. 5) the notch surface 95 moves toward a corner 98 (FIG. 5) which is formed by the intersection of the surfaces 89 and 97 on both levers 85, 87.

If both levers 85, 87 are exactly the same length, they move to the broken line position 87*a*. In reality the levers 85 and 87 have slightly different lengths due to manufacturing tolerances. As a result the corner 98 on the shorter lever first clears the notch surface 95 and, as the lever moves toward the position 87*a*, the beveled surface 97 moves against the notch surface and causes, or urges by camming action, the rod 91 to rotate slightly faster and further to position 95*a*, thereby expediting the release of the longer lever and generally simultaneously with the shorter lever.

In conclusion, the circuit breaker structure disclosed herein provides for an increased closing force for high rating circuit breakers and prevents the development of a high stress upon one latch lever upon release of another lever.

What is claimed is:

1. A circuit breaker, comprising:

(a) a support base;

(b) movable electrical contact means movably disposed upon said support base for controlling the electrical current conducting status of an electrical conductor;

(c) chargeable force supplying means disposed upon said support base for engaging in a discharging operation from a charged state to thus supply the force necessary to move said movable contact means;

(d) operating mechanism means disposed upon said support base and mechanically interconnected with said force supplying means and said electrical contact means for transferring said force from said discharging operation to said movable contact means to move said movable contact means, said operating mechanism means including a plurality of latch members which are also movable under the influence of said discharging operation and which when captured in a latched position maintain said force supplying means in the charged state and which when generally simultaneously released within time limits to an unlatched position allow said discharging operation to begin; and (e) movable latching rod means including a rotatable latching rod having a surface notch movably disposed upon said support base for latching said latch members when in a first latching rod position and for releasing said latch members when moved to a second latching rod position, the initiation of said later movement being provided from a stimulus which is independent of said latch members, latch members having an urging surface thereon which maintains a position of sliding mechanical contact with the surface of said rod after said independent initiation of said later movement and consequent release of said one latch member has begun, said position of sliding mechanical contact between said urging surface and said surface notch operating to complete the movement of said rod to said second latching rod position under the influence of said discharging force supply means, said latter movement thus completing the generally simultaneous release of other latch members within said time limits.

2. The combination as claimed in claim 1 wherein said force supplying means comprises a coil spring.

3. The combination as claimed in claim 1 wherein said movable latching rod comprises a generally cylindrical rod rotatably disposed upon said support base, said rod having surface notches therein which are axially aligned on said rod in a region thereof which is rotatably adjacent to the place of contact therewith by said latch members, rotation of said rod from said first latching rod position to said second latching position aligning said notches with said latch members in such a manner as to allow said latch members to move therethrough, the internal surface of that notch which is aligned with said one latch member being in a non-parallel position relative to said urging surface at the time said one latch member begins to move therethrough so that the movement of said one latch member through said corresponding notch and the concurrent sliding contact therewith tends to continue the rotation of said latching rod under the influence of said discharging force supplying means until said urging surface and said internal surface are parallel.

4. The combination as claimed in claim 3 wherein said force supplying means comprises a coil spring.

5. The combination as claimed in claim 3 wherein said internal surface and said urging surface are displaced by 30° when said latch member begins to move through said notch.

6. The combination as claimed in claim 5 wherein said force supplying means comprises a coil spring.

7. The combination as claimed in claim 6 wherein said movable contact means moves to complete an electrical circuit which includes said electrical conductor.

8. The combination as claimed in claim 3 wherein said movable contact means moves to complete an electrical circuit which includes said electrical conductor.

9. The combination as claimed in claim 1 wherein said movable contact means moves to complete an electrical circuit which includes said electrical conductor.

* * * * *